US006254705B1

(12) United States Patent
Anflo et al.

(10) Patent No.: US 6,254,705 B1
(45) Date of Patent: Jul. 3, 2001

(54) LIQUID PROPELLANT

(75) Inventors: Kjell Anflo, Haninge; Niklas Wingborg, Stockholm, both of (SE)

(73) Assignee: Svenska Rymdaktiebolaget, Solna (SE)

( * ) Notice: Subject to any disclaimer, the term of this patent is extended or adjusted under 35 U.S.C. 154(b) by 0 days.

(21) Appl. No.: 09/258,390

(22) Filed: Feb. 26, 1999

(51) Int. Cl.[7] ..... C06B 47/00; C06B 31/00
(52) U.S. Cl. ..... 149/1; 149/45
(58) Field of Search ..... 149/45, 109.6, 149/1, 36, 2; 60/217, 219

(56) References Cited

U.S. PATENT DOCUMENTS

| | | | | |
|---|---|---|---|---|
| 5,223,057 | | 6/1993 | Mueller et al. | 149/45 |
| 5,254,324 | * | 10/1993 | Bottaro et al. | 423/263 |
| 5,292,387 | * | 3/1994 | Highsmith et al. | 149/19.1 |
| 5,324,075 | * | 6/1994 | Sampson | 280/736 |
| 5,441,720 | * | 8/1995 | Koppes et al. | 423/386 |
| 5,467,714 | * | 11/1995 | Lund et al. | 102/284 |
| 5,468,313 | * | 11/1995 | Wallace, II et al. | 149/53 |
| 5,498,303 | | 3/1996 | Hinshaw et al. | 149/19.6 |
| 5,529,649 | * | 6/1996 | Lund et al. | 149/19.3 |
| 5,587,553 | * | 12/1996 | Braithwaite et al. | 149/19.6 |
| 5,684,269 | * | 11/1997 | Barnes et al. | 149/45 |
| 5,714,714 | * | 2/1998 | Stern et al. | 149/109.6 |
| 5,741,998 | | 4/1998 | Hinshaw et al. | 149/19.6 |
| 5,780,769 | * | 7/1998 | Russell et al. | 149/45 |
| 5,868,424 | * | 2/1999 | Hamilton et al. | 280/741 |
| 5,889,161 | * | 3/1999 | Bottaro et al. | 534/551 |
| 5,962,808 | * | 10/1999 | Lundstrom | 149/19.1 |

FOREIGN PATENT DOCUMENTS

| | | |
|---|---|---|
| 0825074 | 2/1998 | (EP) . |
| 0 950 648 A1 | 10/1999 | (EP) . |
| 9839274 | 9/1998 | (WO) . |
| WO 99/52839 | 10/1999 | (WO) . |

OTHER PUBLICATIONS

Kazakov et al., "Kinetics of the termal decomposition of Dinitramide 2.* Kinetics of the reaction of dinitramide with decomposition products and other components of a solution", *Russian Chemical Bulletin* vol. 47, No. 1, pp. 39–45, (1998).

* cited by examiner

*Primary Examiner*—Michael J. Carone
*Assistant Examiner*—Aileen J. Baker
(74) *Attorney, Agent, or Firm*—Browdy and Neimark

(57) ABSTRACT

Liquid propellants for the purpose of generating hot gases are described, which propellants comprise solution of a dinitramide compound and a fuel, and are especially suited for space applications, and exhibit the following properties exhibit the following properties: low toxicity; no toxic or combustible vapors; high theoretical specific impulse (as compared to hydrazine); high density (as compared to hydrazine); easily ignitable; storable at a temperature between +10° C. and +50° C.; low sensitivity.

16 Claims, 2 Drawing Sheets

LIQUID PROPELLANT

The present invention relates to liquid propellants for the purpose of generating hot gases, or for the generating of energy-rich gases on combustion thereof, which gases can be used in a secondary reaction. These gases are suitable for driving a turbine, vane or piston motor, inflating air bags or for rocket propulsion, or other vessel or vehicle propulsion. More particularly the present invention relates to such propellants especially suited for space applications.

BACKGROUND OF THE INVENTION

A high performing, low risk and low cost monopropellant is the most attractive concept for chemical propulsion. A monopropellant will require a minimum of components to build up a propulsion system and thus will lead to minimum complexity and minimum cost.

The dominating monopropellant for spacecraft propulsion is hydrazine. The major advantages of hydrazine systems are long flight heritage and well-established technology. The major drawbacks of hydrazine systems are the hazards involved. Hydrazine is highly toxic and carcinogenic and hence, rigorous routines are required for manufacturing, handling and operation of hydrazine systems.

Due to hazards, and therefore the total cost, an alternative propellant is highly attractive. Thus, hydrazine will sooner or later be replaced due to cost reduction, safer handling and new requirements on personal safety and environmental requirements. However, this requires that the alternative propellant reach maturity and has been flight qualified.

As indicated above, hydrazine is today widely used as a monopropellant for space applications, but unfortunately it is very toxic, making it hard and expensive to handle. Thus new, less toxic monopropellants are desired.

Ammonium dinitramide (ADN) is a new solid oxidizer, mainly intended for high performance composite rocket propellants. ADN and other similar compounds are the subject of several patents for application as solid composite rocket propellants and as explosives, both for pyrotechnic applications in general and for other uses, such as in inflators for air-bags. The composite explosives of this type typically comprise ADN (or some other compound) as an oxidizer, an energetic binder (e.g. energetically substituted polymers), a reactive metal and other typical propellant ingredients such as curatives and stabilizers. One of the disadvantages of ADN, as a solid oxidizer, is its high hygroscopicity.

SUMMARY OF THE INVENTION

Thus, the existing liquid monopropellants are subject to a number of disadvantages, such as health hazards for personnel handling the propellants, environmental hazards in general due to the toxic nature thereof. A further disadvantage of these liquid monopropellants are the costs associated with the additional safety arrangements required for handling and usage of these monopropellants. Therefore it is an object of the present invention to provide a novel liquid propellant that is low-hazardous both from a handling point of view and from an environmental one, that does not develop smoke and which is liquid. In summary the propellant should exhibit the following properties:

- low toxicity
- no toxic or combustible vapours
- higher theoretical specific impulse (as compared to hydrazine)
- higher density (as compared to hydrazine)

- easily ignitable
- storable at a temperature between +10° C. and +50° C.
- low sensitivity.

The above stated object is achieved according to the present invention with a liquid propellant as defined in claim 1, comprising a solution of an oxidizer of the general formula $$X\text{-}D \qquad (I)$$

wherein X is a cation; and D is the anion dinitramide ($^{-}N(NO_2)_2$), and a fuel. The cation can be selected from the group consisting of metals, organic ions and inorganic ions.

Examples of suitable cations are $OHNH_3^+$, $NH_4^+$, $CH_3NH_3^+$, $(CH_3)_2NH_2^+$, $(CH_3)_3NH^+$, $(CH_3)_4N^+$, $C_2H_5NH_4^+$, $(C_2H_5)_2NH_2^+$, $C_2H_5)_3NH^+$, $(C_2H_5)_4N^+$, $(C_2H_5)(CH_3)NH_2^+$, $(C_2H_5)(CH_3)NH_2^+$, $(C_2H_5)(CH_3)_2N^+$, $(C_3H_7)_4N^+$, $(C_4H_9)_4N^+$, $N_2H_5^+$, $CH_3N_2H_4^+$, $(CH_3)_2N_2H_3^+$, $(CH_3)_3N_2H_2^+$, $(CH_3)_4N_2H^+$, $(CH_3)_5N_2^+$.

The preferred cations are ammonium and hydroxylammomum ions.

Metal ions can be used, but will generally lead to the generation of smoke which is often undesirable. Examples of groups of metals which can be used are the alkali metals, and the alkaline earth metals, especially the former, specific examples being lithium, sodium, and potassium ions.

The propellant comprises a fuel which can be selected from the group consisting of mono-, di-, tri- and poly-hydric alcohols, aldehydes, ketones, amino acids, carboxylic acids, primary, secondary and tertiary amines, and mixtures thereof, or any other compound which can react with the dinitramide oxidizer, and in which said oxidizer is soluble, and/or which is soluble in a suitable solvent, such as water, wherein the oxidizer is soluble, thereby forming a liquid monopropellant exhibiting the above-mentioned desirable characteristics.

Thus, when ADN is used as the oxidizer in the propellants of the present invention, the high hygroscopicity of ADN is a major advantage, especially when said propellants contain water.

Examples of compounds usable as the fuel are polyhydric alcohols such as ethylene glycol, diethylene glycol, triethylene glycol, tetramethylene glycol, ethylene glycol monoethyl ether, propylene glycol, dipropylene glycol, dimethoxytetraethylene glycol, diethylene glycol monomethyl ether, the acetate of ethylene glycol monoethyl ether and the acetate of diethylene glycol monoethyl ether; ketones, such as for example, acetone and methyl butyl ketone; monohydric alcohols such as methanol, propanol, butanol, phenol and benzyl alcohol; ethers, such as dimethyl and diethyl ether, and dioxane; also, the nitrites such as acetonitrile; the sulfoxides such as dimethylsulfoxides; sulfones such as tetrahydrothiophene-1,1-dioxide; the amines such as ethylamine, diethylamine, ethanolamine, hydroxylamine; substituted hydroxylamines such as methyl and ethyl hydroxylamine; and mixtures thereof.

The invention will now be described by way of non-limiting examples and the detailed description of preferred embodiments thereof, with reference to the attached drawing figures, in which:

Solvent mixture refers to fuel+water (i.e. solvent for the oxidizer, in this case ADN);

DETAILED DESCRIPTION OF PREFERRED EMBODIMENTS

Figure 1:
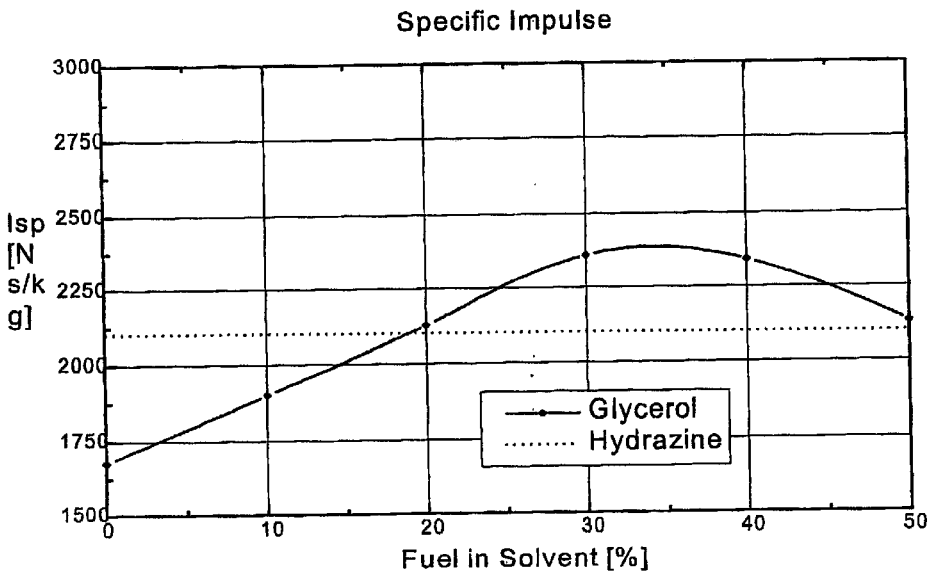
FIG. 1 shows a graph over the theoretical specific impulse for glycerol as compared to hydrazine, given a saturated solution at 0° C., as a function of percentage by weight of fuel in the mixture solvent.

The present invention is directed to a family of liquid propellants having high specific impulse. The preferred propellants include an ionic oxidizer based on dinitramide, water and a mono-, di-, tri- or polyhydric alcohol as a fuel. The propellants according to the invention have several advantages over e.g. hydrazine, as already indicated above, the main ones being low toxicity per se, and essentially non-toxic combustion products.

Preferred examples of the fuel are alcohols, amino acids, and ketones, a suitable example of an amino acid being glycine. Also, ammonia (i.e. ammonia in water) can be used. By way of example a preferred ketone is acetone. More preferably, alcohols usable in the present invention are linear or branched lower alcohols comprising from 1 to 6 carbon atoms. Specific examples of the latter are any of the isomers of methanol, ethanol, ethanediol, propanol, isopropanol, propanediol, propanetriol, butanol, butanediol, e.g. 1,4.butanediol, butanetriol, pentanol, pentanediol, pentanetriol, pentaerytlritol, hexanol, hexanediol, hexanetriol, trimehylolpropane. Most preferably the fuels are non-volatile such as for example glycerol and glycine, the former of which is being preferred.

Examples of oxidizers usable according to the invention are HADN (Hydroxyl Ammonium DiNitramide) and ADN. Typical fuels are represented by methanol, ethanol, acetone, glycine, and glycerol, the latter being a most preferred fuel.

The specific impulse for a given propellant is a qualitative measure of the impulse generated by one unit of mass of the specific propellant under certain standard engine conditions. Specific impulse is inter alia related to the pressure and temperature inside the engine, the composition and thermodynamical properties of the combustion products, the ambient pressure, and the expansion ratio.

In order to determine the specific impulse for various propellants, calculations have been performed using the CET93 thermo-chemical program (Gordon, S., McBride, B. J., "Computer Program for Calculation of Complex Chemical Equilibrium Compositions, Rocket Performance, . . . ". NASA SP-273, March 1976). This program uses the heat of formation, chemical composition, chamber pressure and expansion ratio as input data, and the obtainable output is the combustion temperature, specific impulse (Isp), characteristic velocity (C*) and reaction products.

Calculations were performed with the above program on ADN/water/fuel solutions for different fuels, which will be in more detail in the Examples. In order to obtain the maximum theoretical performance of the solutions the calculations were based on solutions having a stoicheiometric ratio of fuel to ADN. Also, in order to obtain results for said solutions under a temperature within the conventional operating interval of hydrazine, so as to have results comparable to those for hydrazine, the calculations were based on solutions saturated at 0° C.

Calculations for glycerol and hydrazine, respectively were performed using the following data:

| Reactant | Sum Formula | Heat of formation (kJ/mol) |
|---|---|---|
| ADN | N4H404 | −146 |
| Glycerol | C3H803 | −668.6 |
| Water | H2O1 | −285.83 |
| Hydrazine | N2H4 | 50.63 |

The calculations were based on a chamber pressure of 1.5 MPa assuming frozen flow, and the nozzle area ratio was set to 50, with the assumption of expansion to vacuum.

In the thermochemical calculations the heat of solution was not taken in to consideration.

The saturated mix compositions are according to measured data.

Thermo-chemical calculations were made for points at 10% intervals.

As can be clearly seen from FIG. 1, the theoretical specific impulse for a propellant according to the invention containing glycerol as the fuel is markedly higher han for hydrazine, for a certain concentration range, i.e. 20–50% by weight.

Without wishing to be bound by any theory, it is believed that the mechanism for the propellant according to the invention is one of the following possibilities.

It is not likely that glycerol will react directly with ADN. It is at present assumed that the rapid decomposition of ADN starts just below the ignition temperature of +120° C., thereby forming dinitramide acid, $HN(NO_2)_2$, $NO_2$ and $HNO_3$. Dinitramide acid is assumed to be extremely reactive. The ignition of the ADN/water/glycerol propellant mixture indicates that glycerol reacts with acids. This is assumed since the reaction starts well below the boiling point of glycerol.

The auto-ignition of ADN/glycerol, possibly containing some water, at 120° C. further indicates a possible oxidative cleavage of polyhydroxyl compounds. If this is the case the following discussion may be applicable.

Compounds that have hydroxyl groups on adjacent atoms may undergo oxidative cleavage when they are subjected by a suitable aqueous acid, such as, for example, nitric or dinitramidic acids. The reaction breaks carbon-carbon bonds and produces carbonyl compounds (aldehydes, ketons or acids).

Since the reaction usually takes place in quantitative yield, valuable information can often be gained by measuring the number of molar equivalents of acid that are consumed in the reaction as well as by identifying the carbonyl products. It is believed that the oxidation takes place through an intermediate, possibly under formation of radicals and activated complexes.

In the oxidation, a C—O bond is formed at each carbon atom for every C—C bond broken.

When three or more —CHOH groups are contiguous, the internal ones are obtained as formic acid. Thus, oxidation of glycerol, for example, gives two molar equivalents of formaldehyde and one molar equivalent of formic acid.

Oxidative cleavage also takes place when a —OH group is adjacent to the carbonyl group of an aldehyde or keton (but not for an acid or an ester). Glycerolaldehyde yields two molar equivalents of formic acid and one molar equivalent of formaldehyde, while dihydroxylacetone gives two molar equivalents of formaldehyde and one molar equivalent of carbon dioxide.

The acid does not seem to cleave compounds in which the hydroxyl groups are separated by an intervening —CH2— group, nor in which a hydroxyl group is adjacent to an ether or acetal function.

Pure ADN decomposes at temperatures above 95° C. but can be decomposed by acids at lower temperatures. Therefor it is assumed that a solid acid catalyst can decompose ADN or any ions thereof. An example of a solid acid catalyst is the silica-alumina catalyst. The silica to alumina ratio can tune the pH of this catalyst.

A typical liquid propellant formulation (saturated solution at 0° C.) within the scope of the present invention has the following ingredients:

| Ingredient | Weight % |
|---|---|
| ADN | 61 |
| Water | 26 |
| Glycerol | 13 |

It is to be understood that although this is a presently preferred formulation, the percentages given above can be varied within certain intervals, which can easily be established by the person skilled in the art by means of merely routine experimentation, as long as a liquid propellant is obtained. Thus, for a propellant according the invention containing water and glycerol as the fuel, a suitable composition is from 15 to 55% by weight of the fuel in the mixture solvent (mixture solvent=water+fuel), and with reference to FIG. 1, a preferred composition is from 20 to 50% by weight of fuel in the solvent mixture, and more preferably, 25 to 45% by weight of fuel in the solvent mixture and most preferably about 61% of ADN, about 26% of water, and about 13% by weight of glycerol.

As will be obvious to the person skilled in the art, the preferred composition of a specific propellant of the invention will, inter alia, be dependent upon the temperature selected at which the solution will be saturated. Said temperature should be selected so that the propellant will be storable and usable at a selected minimum temperature without the precipitation of any component thereof.

In general the maximum specific impulse is usually found close to the stoicheiometric mixing ratio fuel:oxidizer. However, in a stoicheiometric mixture of ADN and a liquid fuel, all of the ADN might not be dissolved. Thus, water must be added to liquefy the propellant. Solid fuels might also be used if they do dissolve in ADN/water solutions. To lower the flame temperature and/or the sensitivity of the specific propellant, the amount of water can be increased. This would however lower the specific impulse.

However, since the major function of the water in the liquid propellant according to the present invention is considered to be the function of a solvent for the oxidizer and the fuel, it is also conceivable to reduce or even omit the added water from the propellant if a fuel or a mixture of fuels is used in which the oxidizer can be dissolved, i.e. a fuel being a solvent for the oxidizer. This might also lead to an increase in the specific impulse for the specific propellant.

In order to study the behaviour of different combinations and compositions of ADN, water and fuel, solubility and density measurements have been made. Solubility at 0° C. was measured with UV spectroscopy for higher boiling fuels, and density of saturated solutions was measured at room temperature. For volatile fuels the solubility at 0° C. of ADN in water and different fuels were measured in a TGA (thernogravimetric analyzer), where possible, at different water/fuel ratios.

EXAMPLES

In the Examples the theoretical specific impulse (Isp) was calculated for a number of ADN/water/fuel solutions using the CET-93 program (vide supra), and the results of each example are presented in the following tables 1 and 2.

The results should be compared with hydrazine, for which, at the same conditions, Isp=2,200 Ns/kg, and Ivsp of about 2,200 Ns/dm$^3$.

In the following Tables, the temperature given is the theoretical temperature generated on combustion of the specific propellant.

Table 1. Composition at maximum theoretical vacuum specific impulse. Propellants saturated at 0° C. $P_c$=1.5 MPa, $\epsilon$=50.

TABLE 1

Composition at maximum theoretical vacuum specific impulse. Propellants saturated at 0° C. $P_c$ = 1.5 MPa, $\epsilon$ = 50.

| Example no. | 1 | 2 | 3 | 4 |
|---|---|---|---|---|
| Fuel | Acetone | Ammonia | Ethanol | Methanol |
| Fuel in solvent mixture (%) | 25.0 | 40.0 | 23.0 | 32.0 |
| ADN (%) | 67.18 | 77.27 | 60.64 | 64.30 |
| Fuel (%) | 820 | 9.09 | 8.25 | 11.42 |
| Water (%) | 24.62 | 13.64 | 27.36 | 24.28 |
| Density (g/cm$^3$) | 1.349 | 1.372 | 1.332 | 1.324 |
| Isp (Ns/kg) | 2541 | 2515 | 2468 | 2518 |
| Ivsp (Ns/dm$^3$) | 3428 | 3449 | 3287 | 3333 |
| Temperature (K) | 2157 | 2109 | 2002 | 2077 |

TABLE 2

Composition at maximum theoretical vacuum specific impulse. Propellants saturated at 0° C. $P_c$ = 1.5 MPa, $\epsilon$= 50.

| Example No. | 5 | 6 | 7 | 8 |
|---|---|---|---|---|
| Fuel | Glycerol | Ethylene glycol | 1,4-Butan-diol, BDO | Trimethylol-propane, TMP |
| Fuel in solvent mixture (%) | 33 | 33 | 24 | 25 |
| ADN (%) | 61.00 | 62.00 | 63.62 | 64.08 |
| Fuel (%) | 12.87 | 12.54 | 8.73 | 8.98 |
| Water (%) | 26.13 | 25.46 | 27.65 | 26.94 |
| Density (g/cm$^3$) | 1.420 | 1.391 | 1.390 | 1.402 |
| Isp (Ns/kg) | 2425 | 2457 | 2460 | 2470 |
| Ivsp (Ns/dm$^3$) | 3444 | 3418 | 3418 | 3463 |
| Temperature (K) | 1972 | 2009 | 2005 | 2029 |

Figure 2:
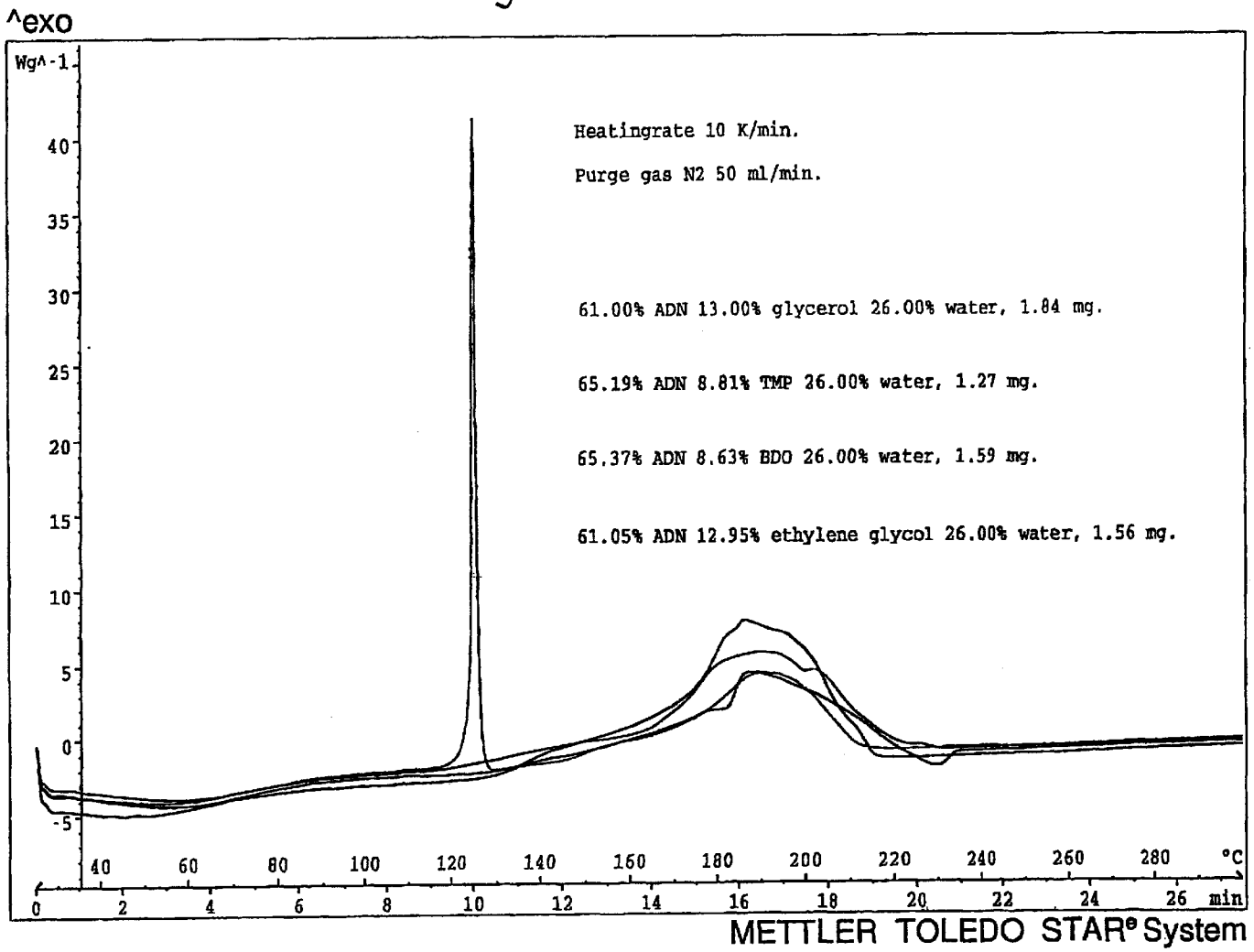
FIG. 2 depicts a Differential Scanning Calorimetry (DSC) chart showing the progress of the exothermal reactions of different propellants of the invention as the temperature is gradually increased.

The auto-ignition of the propellant of Example 5, as measured with the DSC and shown in FIG. 2, at 120° C. has been observed in practical experiments in which the propellant is added into a heated small container heated to a temperature of 120° C. However, it should be noted that some water will evaporate on heating, thus changing the ratio of the components of Example 5.

From the above table it can also be seen that the propellants of the invention exhibit a high density, as compared to a hydrazine containing one, leading to an attractively high volume specific impulse.

It is to be understood that the specific impulse, and especially the volume specific impulse for any of the above-mentioned ADN/water/fuel solutions, in contrast to hydrazine, will be increased if solutions saturated at a higher temperature than 0° C. are used, since the solubility of the oxidizer and fuel generally increases with the temperature. Thus, the above-mentioned values based on solutions saturated at a temperature of 0° C. are to be regarded only as exemplary, and indicative of the excellent impulse characteristics of the liquid propellants of the present invention.

Figure 3:
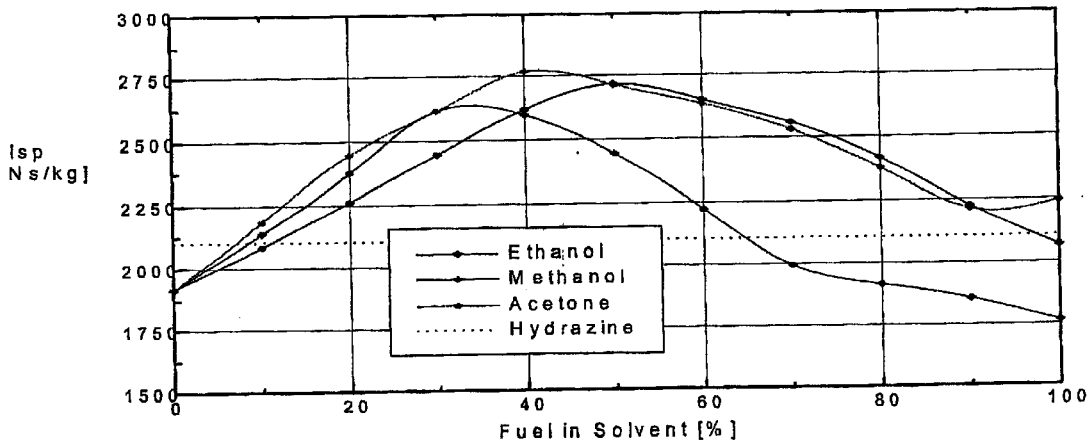
FIG. 3 shows a graph over the theoretical specific impulse for different ADN based propellants, having different fuels, as a finction of the percentage by weight of the fuel in the solvent mixture, as compared to hydrazine.

Thus, as can be clearly seen from FIG. 3, the maximum specific impulse (Isp) values for different propellants, comprising solutions saturated at 22° C., are higher than the ones presented in Table 1 for the corresponding solutions saturated at 0° C.

The solubility of HADN in water or water+fuel is expected to be markedly higher than the one for ADN, and will thus, when used in the propellants of the present invention, lead to even higher Isp values, and, more importantly, to even higher Ivsp values.

Whereas the above calculations were based on stoicheiometric ratios of oxidizer to fuel, it might in some instances, for example, be desirable to use sub-stoicheiometric amounts of the oxidizer in order to be able to dissolve said oxidizer in a certain fuel without the need of added water, or in order to obtain energy rich gases which can be used in a secondary reaction or combustion process.

An at present preferred composition is ADN/water/glycerol, mainly because it ignites at approximately 200° C., and it does not emit toxic or flammable vapours prior to ignition, unlike fuels such as ethanol, methanol and acetone, and is thus not volatile.

Also, small amounts of added substances, such as stabilizers or any other conventionally used substances in the art can also be included in the propellants of the invention without departing from the scope of the invention. For example, since ADN is not stabile in acidic environment, small amounts of a suitable base might be added in order to stabilize the dinitramide However, it is conceivable that other combinations of oxidizer/water/fuel within the broad definition of the invention may have better performance, and it is to be regarded as being within the abilities of the man skilled in the art to find such combinations without undue experimentation.

What is claimed is:

1. A liquid propellant formulation comprising a solution of (A) a compound of the formula

X-D wherein X is a cation and

D is a dinitramide anion, and (B) a solvent comprising a fuel, said fuel being an energetic compound selected from the group consisting of methanol; phenol; benzyl alcohol; an isomer of propanol, isopropanol, pentanol, hexanol; di-, tri- and polyhydric alcohols having 1–6 carbon atoms; amino acids; carboxylic acids; ketones; aldehydes, primary, secondary, and tertiary amines; and saturated liquid hydrocarbons.

2. The propellant as claimed in claim 1, wherein said solvent further comprises a compound in which the compound X-D and the fuel are soluble.

3. The propellant as claimed in claim 2, wherein the solvent is water.

4. The propellant as claimed in claim 1, wherein the fuel is a solvent for X-D.

5. A liquid propellant composition consisting of a solution of (A) a compound of the formula

X-D wherein X is a cation and

D is a dinitramide anion, and (B) a solvent comprising a fuel.

6. The propellant as claimed in claim 1, wherein said cation is selected from the group consisting of organic ions, inorganic ions and metals.

7. The propellant as claimed in claim 1, wherein said cation is selected from the group consisting of $OHNH_3^+$, $NH_4^+$, $CH_3NH_3^+$, $(CH_3)_2NH_2^+$, $(CH_3)_3NH^+$, $(CH_3)_4N^+$, $C_2H_5NH_4^+$, $(C_2H_5)_2NH_2^+$, $(C_2H_5)_3NH^+$, $(C_2H_5)(CH_3)NH_2^+$, $(C_2H_5)(CH_3)NH_2^+$, $(C_2H_5)(CH_3)_2N^+$, $(C_3H_7)_4N^+$, $(C_4H_9)_4N^+$, $N_2H_5^+$, $CH_3N_2H_4^+$, $(CH_3)_2N_2H_3^+$, $(CH_3)_3N_2H_2^+$, $(CH_3)_4N_2H^+$, $(CH_3)_5N_2^+$.

8. The propellant as claimed in claim 1, wherein the composition forms a saturated solution of ADN at 0° C.

9. The propellant as claimed in claim 1, wherein the fuel is selected from glycine, acetone, methanol, ethanol, and glycerol.

10. The propellant as claimed in claim 1, wherein the X group represents $NH_4^+$.

11. The propellant as claimed in claim 1, wherein the X group represents $OHNH_3^+$.

12. A liquid propellant formulation comprising a solution of:

(A) a compound of the general formula

X-D (1)

wherein X is a cation; and

D is a dinitramide anion, and (B) a fuel comprising glycerol.

13. A liquid propellant formulation comprising a solution of:

(A) A compound of the general formula

X-D (1)

wherein X is a cation; and

D is a dinitramide anion, and (B) a solvent mixture comprising water and a fuel, wherein said fuel comprises from 15 to 55% by weight of said solvent mixture.

14. The propellant of claim 13 comprising about 61% ammonium dinitramide about 26% water, and about 13% by weight glycerol.

15. The liquid propellant of claim 13 wherein said fuel comprises from 20 to 50% by weight of said solvent mixture.

16. The liquid propellant of claim 13 wherein said fuel comprises from 25 to 45% by weight of said solvent mixture.

* * * * *